US008840739B2

(12) United States Patent
Song et al.

(10) Patent No.: US 8,840,739 B2
(45) Date of Patent: Sep. 23, 2014

(54) CORROSION RESISTANCE OF MAGNESIUM ALLOY ARTICLE SURFACES

(75) Inventors: Guangling Song, Troy, MI (US); Zhengwen Pu, Lexington, KY (US)

(73) Assignee: GM Global Technology Operations LLC, Detroit, MI (US)

( * ) Notice: Subject to any disclaimer, the term of this patent is extended or adjusted under 35 U.S.C. 154(b) by 615 days.

(21) Appl. No.: 13/093,028

(22) Filed: Apr. 25, 2011

(65) Prior Publication Data

US 2012/0067465 A1 Mar. 22, 2012

Related U.S. Application Data

(60) Provisional application No. 61/383,425, filed on Sep. 16, 2010.

(51) Int. Cl.

| | |
|---|---|
| ***C22F 3/00*** | (2006.01) |
| ***B32B 15/01*** | (2006.01) |
| ***C22C 23/00*** | (2006.01) |
| ***C22F 1/06*** | (2006.01) |

(52) U.S. Cl.

CPC . *C22F 1/06* (2013.01); *C22C 23/00* (2013.01); *C22F 3/00* (2013.01)

USPC ..... 148/516; 72/68; 72/69

(58) Field of Classification Search

USPC ..... 148/667

See application file for complete search history.

(56) References Cited

U.S. PATENT DOCUMENTS 5,816,899 A * 10/1998 Hart et al. ..... 451/272
5,826,453 A * 10/1998 Prevey, III ..... 72/75
6,935,925 B1 * 8/2005 Agrawal et al. ..... 451/8

OTHER PUBLICATIONS

Zhang et al. Scripta Materialia, 2005, vol. 52, p. 1011-1015.*

Kaese et al. Materials for Transportation Technology, 2000, p. 52-57.*

Alvarez-Lopez et al. Acta Biomaterialia, available online May 2009.* http://en.wikipedia.org/wiki/Roller_burnishing, Apr. 2013.*

Yamasa-1, YAMASA 2008 1 E, http://www.youtube.com/watch?v=fVikoPAR0WA, 2009.*

Yuan et al. Nano-machining Experiment of Metal Materials Polishing with Ice Desk, High Density Microsystem Design and Packaging and Component Failure Analysis, 2005.*

Yamasa, http://yamasa.com.tr/149/2/6/yamasa/singlerollerburnishing.aspx, 2009, the date is evidenced by Yamasa-1.*

Protective and Decorative Coatings; (English translation attached).

* cited by examiner

*Primary Examiner* — Roy King
*Assistant Examiner* — Xiaowei Su
(74) *Attorney, Agent, or Firm* — Reising Ethington P.C.

(57) ABSTRACT

Surfaces of magnesium-base alloy workpieces may be mechanically worked and deformed to increase their resistance to corrosion, especially corrosion occurring in the presence of water or water and salt or other corrosive media. Workpiece surfaces that are to be thus protected are engaged in squeezing, sliding, and frictional contact with a suitable burnishing or other working tool that traverses the surface to compress and deform it and to refine the metallurgical grain structure. For example, the grain size is reduced in a surface layer that may extend to a depth of up to a few millimeters. And grain orientation is altered within that depth. The tool is not employed to intentionally remove material from the surface of the workpiece. The initial dimensioning of the workpiece may take into consideration the alteration of surfaces by the mechanical working process.

12 Claims, 6 Drawing Sheets

CORROSION RESISTANCE OF MAGNESIUM ALLOY ARTICLE SURFACES

This application claims priority based on provisional application 61/383,425, titled "Improvement of Corrosion Resistance of Magnesium Alloys by Burnishing," filed Sep. 16, 2010 and which is incorporated herein by reference.

TECHNICAL FIELD

This invention pertains to improving the resistance of surfaces of magnesium-based alloy workpieces to aggressive media induced corrosion. More specifically, this invention pertains to the burnishing, or like mechanical working, of surfaces of magnesium alloys, such as AZ31 magnesium alloy, to refine the metallurgical grain structure in surface layers of magnesium workpieces for the purpose of increasing their resistance to corrosive environments.

BACKGROUND OF THE INVENTION

Magnesium-based alloys are potential lightweight materials for automotive applications and the use of the alloys may significantly improve the vehicle fuel economy. However, the poor corrosion resistance of Mg alloys significantly limits their wider application. The corrosion performance of Mg AZ31 alloy is among the poorest compared with other common cast Mg alloys, such as AZ91 or AM60. There is a need for a method of improving the corrosion resistance of workpieces of susceptible magnesium based alloys.

SUMMARY OF THE INVENTION

Methods are provided for the relatively simple and inexpensive mechanical working of surfaces of magnesium-based alloys (typically containing at least about ninety percent by weight magnesium) for the purpose of refining the grains of a surface layer of the workpiece in a manner that reduces the susceptibility of the treated workpiece layers to corrosion in water-containing, salt and water containing, and other aggressive media containing environments. Such mechanical working processes of surfaces of magnesium alloy workpieces improves opportunities for their use, for example, in components of automotive vehicles that are exposed to water and salt. The surface working may also increase the fatigue resistance of the workpiece.

In accordance with embodiments of the invention, magnesium alloy workpieces, such as cast workpieces or wrought bar, tube, sheet, or strip materials are burnished with a mechanical tool that plastically deforms surface regions of the workpiece to selectively reduce the size of the metallurgical grains in the surface layer. The orientation of the refined grains may also be altered. Both changes in the grains in the surface layer are found to reduce the tendency for the deformed surface layer to corrode. The tool is suitably formed of a material that is harder than the magnesium workpiece, such as a tool steel alloy material, or the like, and the surface of the tool has a roughness determined for the squeezing, sliding (such as rolling and sliding), frictional engagement with the workpiece surface in a manner that refines the grain structure in the surface region. Knurling tools or other non-cutting surface working tools may also be used. Such mechanical working of the workpiece is performed so as to refine the grain size of the microstructure in a surface layer to a depth of about three millimeters or so as determined to be suitable for improving resistance to corrosion on the workpiece shape and magnesium-base alloy composition of interest. In general, the sizes of the metallurgical grains in the surface layer of the workpiece are reduced to a few microns or even to a nanometer level by the mechanical deformation.

Practices of the invention are demonstrated below in the text of this specification on AZ31 magnesium-based alloys because of their particular susceptibility to salt water corrosion. AZ31 alloys are nominally composed, by weight, of about three percent aluminum, one percent zinc, and the balance magnesium except for very small amounts of other elements present in materials used in formulating the workpiece material. Workpieces of AZ31 alloy are often made by casting into desired workpiece shapes, or by casting, and hot rolling into slabs, strips, or sheets of desired thickness. But the practice of the invention may be adapted to other magnesium-based alloys and to many workpiece configurations.

The practice of the invention has been demonstrated by burnishing (or like mechanical working) of surfaces of workpieces with the workpiece initially at ambient temperature. The methods of this invention may also be practiced by burnishing while the workpiece is being cooled such as by spraying the surface of the workpiece with a cooling fluid, such as with liquid nitrogen, as the surface layer is being worked. In other embodiments, the workpiece may be partially immersed in a cooling liquid.

One or more surfaces of a magnesium-based alloy workpiece may be selected to be worked in accordance with this invention to reduce the susceptibility of the workpiece to water-based corrosive attack (or other corrosive media) from the environment in which the article is expected to serve. Such surface working for grain refinement may be practiced on a generally finished workpiece shape or on a precursor shape. Since each worked surface experiences some level of deformation, a workpiece may be initially slightly over-sized for the corrosion resisting treatment if a surface dimension may be affected by the method of this invention.

Other objects and advantages of the invention will be apparent from a detailed description of illustrative embodiments of the invention. Reference will be made to drawing figures which are summarized in the following section of this specification.

DESCRIPTION OF PREFERRED EMBODIMENTS

Practices of this invention are used to work surfaces of a magnesium-based alloy article to intentionally deform and reduce the grain size of the magnesium-containing material in the outer few millimeters of the surface layer. Metal material is not removed from the surface, but the surface layer is reshaped by burnishing, knurling, or the like, to form a thin layer of fine-grained microstructure that is more resistant to galvanic corrosion caused by exposure of the surface to salty water and air. In some embodiments of the invention such working may be performed at ambient temperatures (for example, about 25° C.) without cooling of the workpiece. The worked surface regions will, of course, experience some heating. In other embodiments of the invention, the worked surface portions of the workpiece may be cooled with a fluid. Usually such cooling leads to smaller grain sizes in the worked areas. For example, cooling with liquid nitrogen has been used for this purpose. The working is practiced to reduce the grain size of the surface material to a depth of, for example, about one to three millimeters. Often it is desired to obtain grains sizes in the range of about one to five micrometers in largest dimension, or smaller.

Thus, practices of the invention may be particularly useful in preparing magnesium alloy components which, for example, are located on automotive vehicles and exposed to aggressive water-containing materials that react chemically and corrosively with magnesium and its alloys.

Figure 1A:
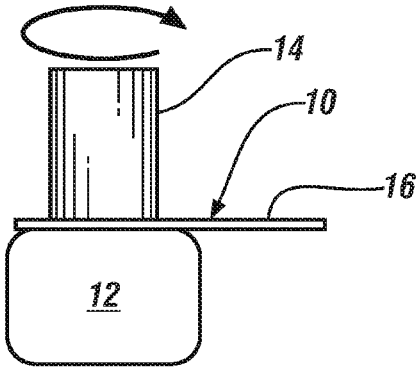
FIG. 1A is a schematic drawing illustration of an end of a round cylindrical steel burnishing tool being rotated and pressed into a surface region of a magnesium alloy workpiece in the form of a strip. The rotating tool may be translated over a surface region of the workpiece. The strip workpiece is supported on an anvil as its surface is being deformed.

In FIG. 1A a workpiece strip 10 of magnesium alloy material (such as AZ 31 magnesium alloy) is supported on an anvil 12, or a like supporting device, for burnishing with rotating friction tool 14. Workpiece strip 10 may, for example be a portion of a vehicle body panel that is likely to be exposed to salt water or the like when used in an automotive vehicle. Anvil 12 may be formed of any suitable load bearing material that is compatible with a magnesium alloy workpiece. Rotating friction tool 14 maybe formed of a hard, high melting tool steel alloy or the like. In other embodiments of the invention, a knurling tool or other non-cutting working tool may be used.

Friction tool 14 is pressed against a side surface region 16 of workpiece strip 10 and rotated. The rotating tool 14 may be traversed over a surface 16 of the workpiece 10 for the purpose of working a predetermined area of the surface 16 of the article 10. The pressing force, rate of tool rotation, and working time are determined by experiment or other experience to deform and reduce the grain size of the surface material 16 to improve its metallurgical resistance to corrosion, such as, for example, galvanic corrosion in the presence of water. Often the goal is to thus affect the microstructure of a surface 16 of the workpiece 10 to a depth of about one to three millimeters. The size and shape of the article prior to such deformation may be determined to accommodate such deformation will retaining a desired dimension or shape of the workpiece.

Figure 1B:
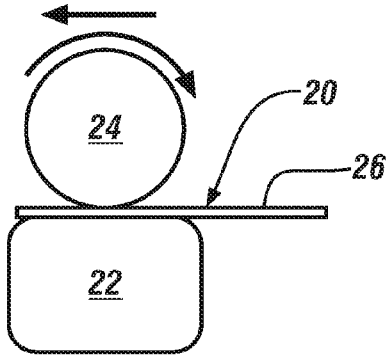
FIG. 1B is a schematic drawing illustration of a circumferential surface of a round cylindrical steel burnishing tool being rotated as a roller and pressed into a surface region of a magnesium alloy workpiece in the form of a strip. The strip workpiece is supported on an anvil during surface working of the strip.

FIG. 1B illustrates a similar magnesium alloy workpiece strip 20 and anvil support 22. In this example, a rotating steel roller 24 is pressed against a side surface 26 of workpiece strip 20 while traversed across the surface 26. In FIG. 1B, the arrow indicates that the direction of traversing is opposed to the direction of rotation, but the direction of traversing may be varied to each practice of the invention. This pressing and shearing force is applied so as to deform a thin surface 26 layer of magnesium alloy material of workpiece 20 and to improve its resistance to galvanic corrosion when wetted with water.

Figure 1C:
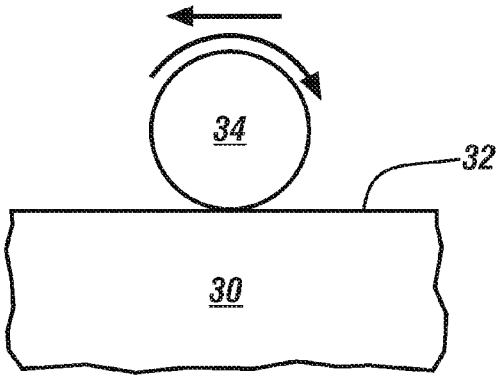
FIG. 1C is a schematic illustration of a rotating steel roller pressed into a surface region of fragmentary view of a formed magnesium alloy workpiece. The roller is translated over a surface region of a fragmented portion of a shaped magnesium alloy workpiece.

FIG. 1C illustrates the working of a surface portion 32 of a magnesium-based alloy workpiece 30. Workpiece 30 may be a casting or other formed shape of a magnesium-based alloy article. In this example, a selected surface portion 32 is being worked and deformed by steel roller 34 which is being rotated in one direction, pressed against surface 32 and traversed across surface 32. In FIG. 1C, the arrow indicates that the direction of traversing is opposed to the direction of rotation, but, again, the direction of traversing may be varied to each practice of the invention. Again the parameters of the surface working process is to refine the grain size and structure of a thin layer of surface 32 (one to three millimeters or so in depth) to improve the resistance of the magnesium material to galvanic corrosion when exposed to water.

Figure 1D:
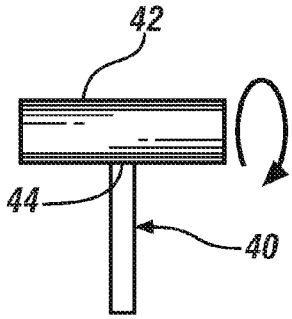
FIG. 1D is a schematic side view illustration of rotating steel roller pressed into and translated along the edge surface of a magnesium alloy strip work piece.

FIG. 1D illustrates the use of rotating steel roller 42 to work edge surface 44 of magnesium alloy strip workpiece 40. Again, the selected edge portion 44 of strip workpiece 40 was worked to a depth to obtain a refined grains structure more resistant to water-based corrosion than untreated portions of the workpiece 40.

Figure 1E:
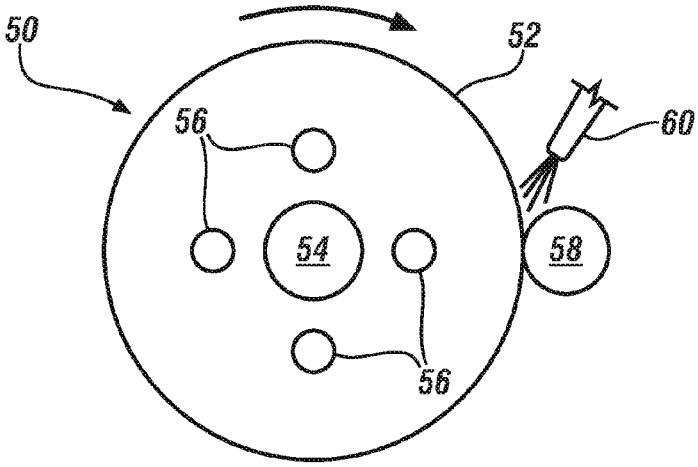
FIG. 1E is a schematic side view illustration of a rotating AZ31 magnesium alloy disk in which the circumferential edge surface of the disc is engaged under pressure by a fixed tool steel roller. In a specific example, described below in this specification, the disc is rotated by a lathe. A spray of liquid nitrogen is applied to the interface of the edge of the rotating disc and the steel roller.

FIG. 1E illustrates the processing of an edge surface 52 of a disc 50 of a magnesium alloy. The work material studied was the commercial AZ31B-O temper magnesium alloy. The work material was received in the form of a 3 mm thick sheet. The sheet material had been produced from a cast slab of AZ31B composition by rolling. The final sheet material was in an O-temper condition. Disc specimens (each as illustrated at 50) with 130 mm diameter were cut from the sheet. The circumferences of the disc specimens were further machined to make them suitably round for mounting on the chuck of a lathe. This reduced the diameters of the disks to 128 mm. The disks were subsequently subjected to burnishing as described below. As illustrated in FIG. 1E, a center hole 54 and four radial anchoring holes 56 were drilled in the disc specimens for mounting to a lathe, not shown. As described in more detail in a following paragraph, a non-rotating roller 58, longer that the thickness of each disc was pressed into the edge 52 of the rotating disc 50. The rotating edge 52 of each disc 50 was cooled with a spray of liquid nitrogen with spray nozzle 60.

Mechanical Working of the AZ31 Disc by Burnishing

These burnishing experiments were conducted on a Mazak Quick Turn-10 Turning Center equipped with an Air Products liquid nitrogen delivery system, which is capable of spraying liquid nitrogen in a managed steady stream to the processing zone for cooling. As described with respect to FIGS. 1A-1D, working of the magnesium alloy workpiece may be accomplished without such cooling. Or, alternatively, a workpiece may be cooled with other suitable cooling fluids and by other cooling practices.

The AZ31B Mg disc 50 was fixed in the lathe chuck and was rotating during processing. A roller 58 made of high speed steel alloy and having a diameter of six millimeters was pushed radially inwardly against the circumferential edge 52 of the rotating disc 50 at a feed rate. Different from the traditional burnishing method, the roller used here was not rotated in order to introduce more severe plastic deformation from the forceful sliding contact with the disc. Some lateral movement of the roller, transverse to the disc, was also employed in working of the edge of the rotating disc. During processing, liquid nitrogen was sprayed to the processing zone as shown in FIG. 1E. The application of liquid nitrogen was intended to reduce the temperature of the worked disc material during processing and introduce significant grain refinement near the surface after processing. However, it has been determined that such cooling is not necessary for all workpiece shapes and magnesium compositions.

Burnishing speed refers to the linear speed at the contact point between the fixed roller 58 and the rotated disc 50. It was set at 100 m/min. The feed rate of the non-rotating roller tool into the circumferential surface of the rotated disc was 0.01 mm/rev of the disc. The burnishing process was stopped when the final diameter of the AZ31 disc was reduced by the burnishing-induced deformation from 128 mm to 125 mm.

This burnishing process was practiced on a number of AZ31 discs prepared as described.

Grinding Treatment

To eliminate any possible influence of surface roughness on corrosion resistance, some un-burnished AZ31B Magnesium alloy samples were abraded successively with course grade of sand paper and finer grades down to 4000 grit sand paper. In the following sections these samples are characterized as ground samples or as samples prepared by grinding. These samples, after grinding, were employed as the reference for the corrosion resistance comparison, presented subsequently, between samples prepared by burnishing and grinding.

Characterization Methods

After burnishing, metallurgical samples were cut from the burnished discs. After cold mounting, grinding and polishing, acetic picric acid solution was used as an etchant to reveal the grain structure. A KEYENCE digital microscope VHX-600 was used to observe and record the microstructures of the burnished samples.

Surface roughness values of the burnished and ground samples were measured using a ZYGO New View 6000 measurement system which was based on white light interferometry.

The hardness of the samples from the surface to the bulk material was measured using a Hysitron Tribolndenter. The load used was 8 mN.

Electrochemical Measurements

A Solatron 1280 potentiostat system was used for polarization curve and AC impedance measurements. Only the processed disc surfaces were exposed to the testing solution and all the other surfaces are protected by a thick layer of MICCROSTOP lacquer. The exposed area was 1.5 $cm^2$. The testing solution was 5 wt. % NaCl. A platinum gauze was used as a counter electrode and a KCl-saturated Ag/AgCl electrode was used as a reference in the cell. During AC impedance measurements, the frequency ranged from 17,777 Hz to 0.1 Hz with 7 points/decade, and the amplitude of the sinusoidal potential signal was 5 mV with respect to the Open Circuit Potential (OCP). Potentiodynamic polarization curve measurements were performed at a potential scanning rate of 0.1 mV/s from −0.3V vs. OCP to −1.0V vs. reference.

Hydrogen Evolution Measurements

In addition to electrochemical methods, a hydrogen evolution method was also used to compare the corrosion rates of samples after cryogenic burnishing and after grinding. The samples were mounted in epoxy resin and only the processed surface was exposed to 5 wt. % NaCl. The exposed area was 1.5 $cm^2$. Pipettes with 0.1 mL interval were used to collect the evolved hydrogen from the samples.

Results and Discussion

Microstructure

Figure 2A:
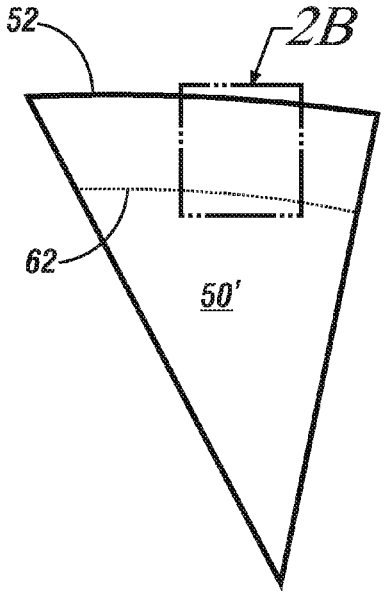
FIG. 2A shows a pie-shaped portion taken from the outer circumferential edge of an AZ31 disc which was burnished using the process shown in FIG. 1E. The sample was etched with acetic picric acid to reveal its grain structure.
Figure 3:
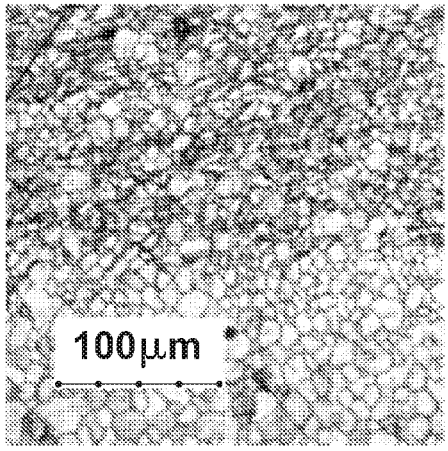
FIG. 3 is a photomicrograph (at 1000×) of a section, outlined in FIG. 2B, of the sample portion shown in FIG. 2B, and labeled "3", which shows the boundary between the burnished and un-burnished material of the disc of FIG. 2A. The upper edge of the micrograph corresponds generally to the location of point 6 of FIG. 2B and the lower edge of the micrograph corresponds generally to the location of point 7 in FIG. 2B.
Figure 2B:
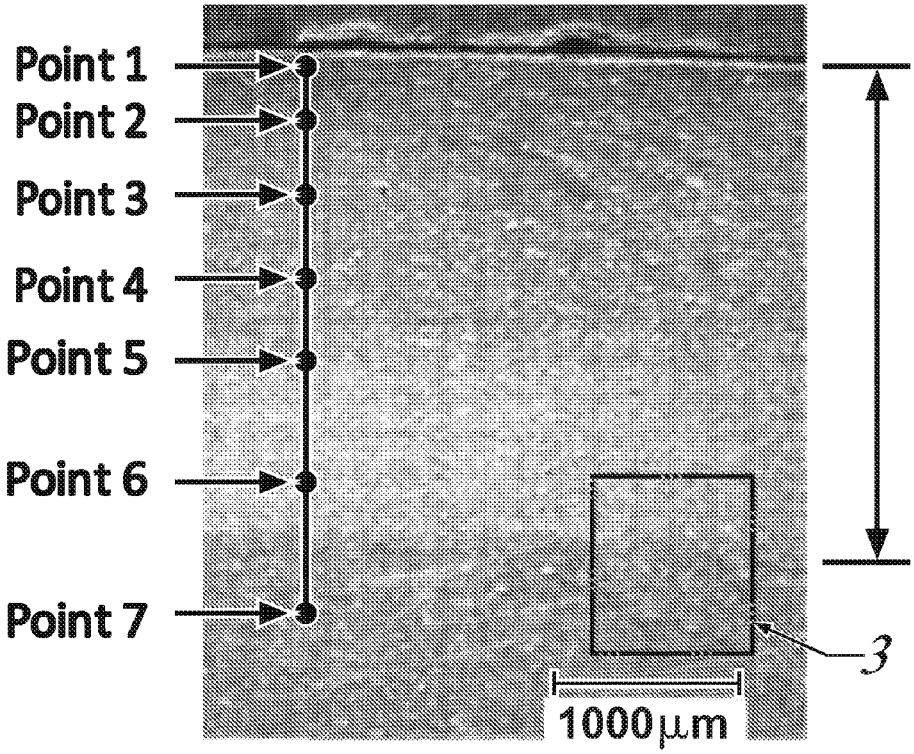
FIG. 2B is a photomicrograph (at 30× magnification) of the section, outlined in FIG. 2A, of the cryogenically burnished AZ31 disc showing the microstructure from the outer edge surface of the disc after working to a depth of about three millimeters. The dotted line generally parallel to the edge of the disc indicates the approximate distance from the edge in which the grain structure was affected by the burnishing. The numbers 1-7 on the FIG. 2B photograph show locations of the seven enlarged numbered photomicrographs of FIG. 4.

FIG. 2A illustrates the shape and location of a pie-shaped segment 50' removed from a burnished, etched magnesium alloy disc (50 as illustrated in FIG. 1A). As described, the diameter of the disc had been reduced to about 125 mm, and the removed segment included a portion of the circumferential edge 52 and radially inward side surfaces. The drawn square on FIG. 2A indicates an area of the side surface of the disc segment which was cleaned and photographed to provide an enlarged image of the surface. Contrast variations, indicative of microstructural variations, between the surface and interior of the disc are observed and are more clearly seen in higher magnification (30×) view of FIG. 2B. There is a clear interface between the processing-influenced zone and the bulk. The dimension line with upper and lower arrow heads at the right side of FIG. 2B extends from the surface (upper arrow head) of the disc segment to the interface (lower arrow head). This interface is also indicated by dotted line 62 in FIG. 2A. The interface is also shown in FIG. 3 under 1000× magnification. FIG. 3 illustrates the 1000 micrometer square region indicated by the box in the lower-right portion of FIG. 2B. The total thickness of the processing-influenced circumferential disc layer is 3.40±0.01 mm.

Also indicated on FIG. 2A is a linear strip extending radially inwardly form the burnished edge and indicating seven point locations, the grain structures of which are further illustrated by the photomicrographs of FIG. 4 which illustrate, respectively, the microstructures of the side surface of the disc segment at points 1-7, where Point 1 is the worked edge and Point 7 in the innermost point below the processing influenced zone of this workpiece.

While no twinning can be seen in the initial material, there is a high density of deformation twinning above the interface as shown in FIG. 3. The location of twinning is near the bottom of the processing-influenced layer. Twinning gradually disappears when it becomes closer to the top surface. The deformation twinning indicates that the temperature near this interface is lower compared with the top portion of the layer.

Figure 4:
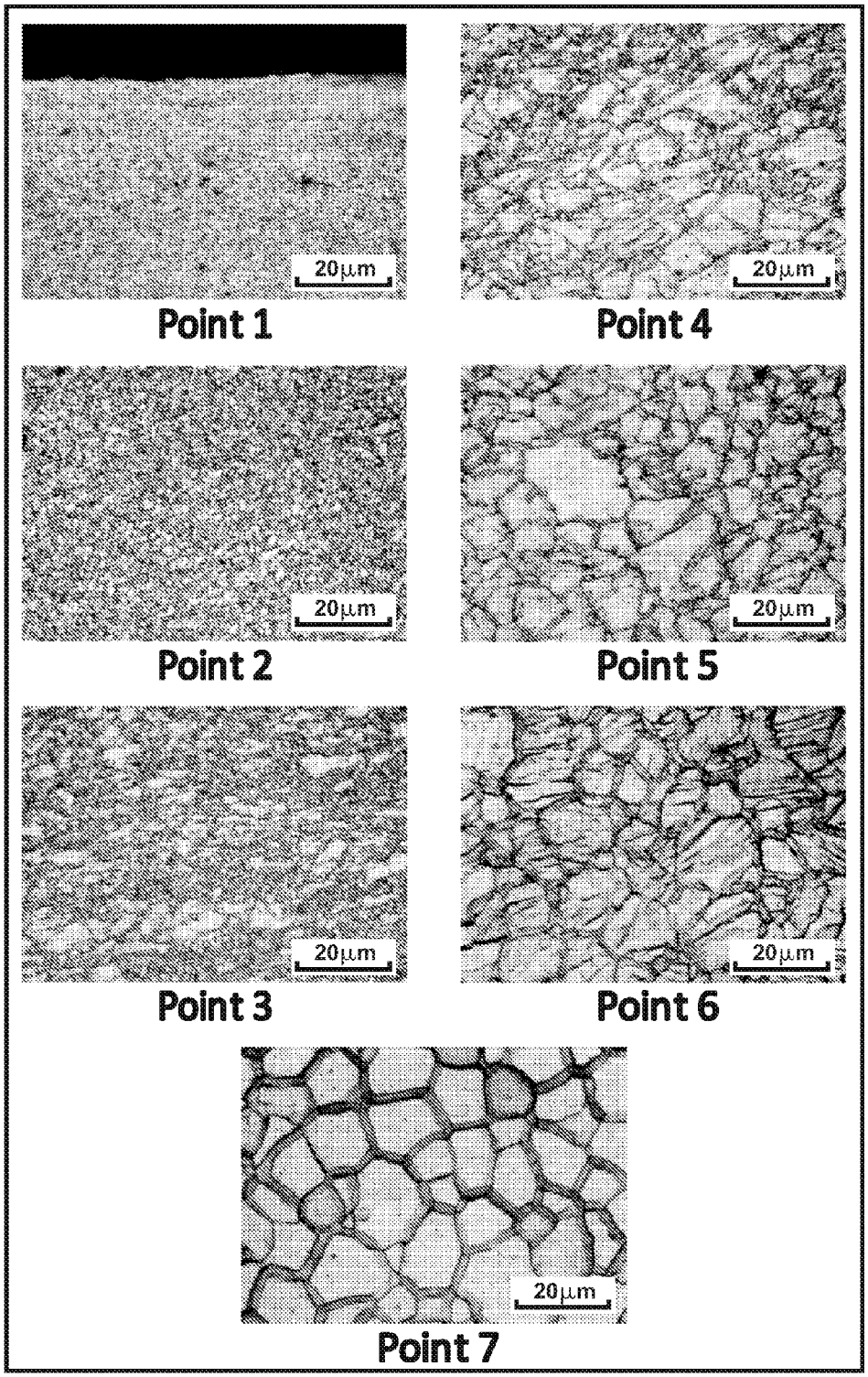
FIG. 4 consists of seven photomicrographs (at 5000×) respectively, at locations 1-7 of FIG. 2B.

Clear evidence of dynamic recrystallization (DRX) of the grain microstructure is observed in six of the seven micrographs of FIG. 4. The microstructures of FIG. 4 at the seven different points located in FIG. 2B, were obtained using the VHX-600 digital microscope, and are shown at a ×5000 magnification.

Figure 5:
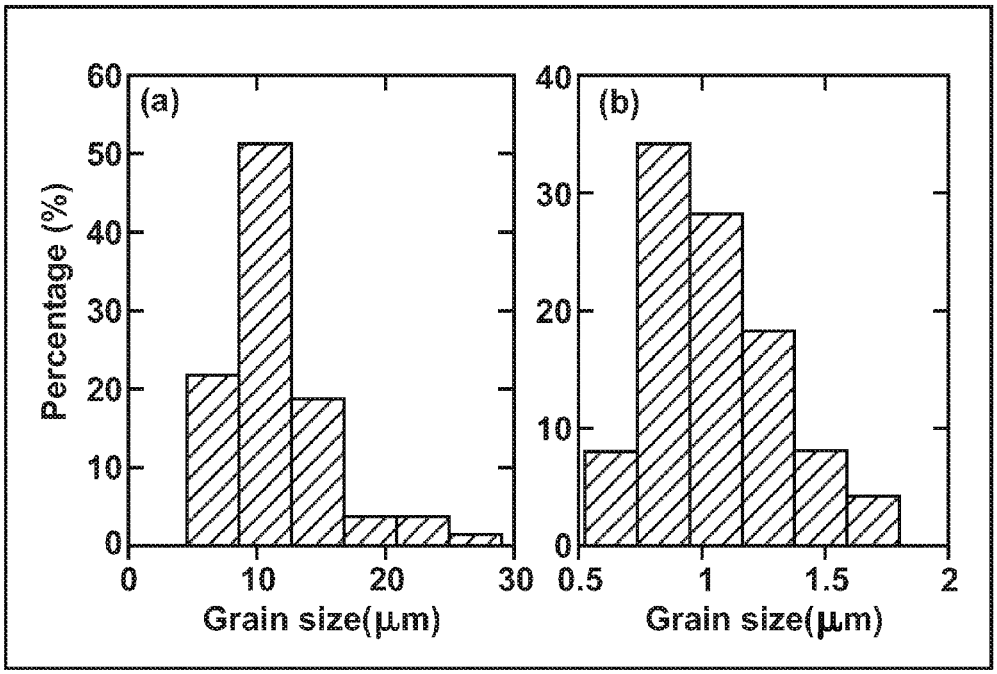
FIG. 5 consists of two bar graphs, with different grain size scales, showing the percentage of grains lying within specified grain size ranges for an unmodified AZ 31B Mg sample (Graph (a)) and an AZ 31B Mg sample after cryogenic burnishing (Graph (b)) at the sample surface (Location 1 in FIG. 2B).

The image at Point 7 in FIG. 4 represents the initial microstructure and Point 1 is the microstructure near the surface after cryogenic burnishing. It is clear that significant grain refinement occurred near the surface. As shown in the FIG. 5 bar graphs, the grain size after cryogenic burnishing, graph 5(*b*), is reduced to 1.03±0.26 μm from the initial grain size of 11.88±4.54 μm, graph 5(*a*). Not only is the grain size reduced, but also the distribution of grain size becomes more uniform (less scatter).

From Point 2 to Point 4 of FIG. 4, there is a clear trend that the quantity of ultrafined grains is decreasing. The strain induced by cryogenic burnishing or ambient temperature burnishing should decrease from the surface to the bulk material where the material was not influenced by the process and the strain becomes smaller.

The microstructural features at Point 6 of FIG. 4 further shows that deformation twins are dominant in the transition layer from the processing-influenced microstructure to the initial microstructure.

Hardness Measurements

Figure 6:
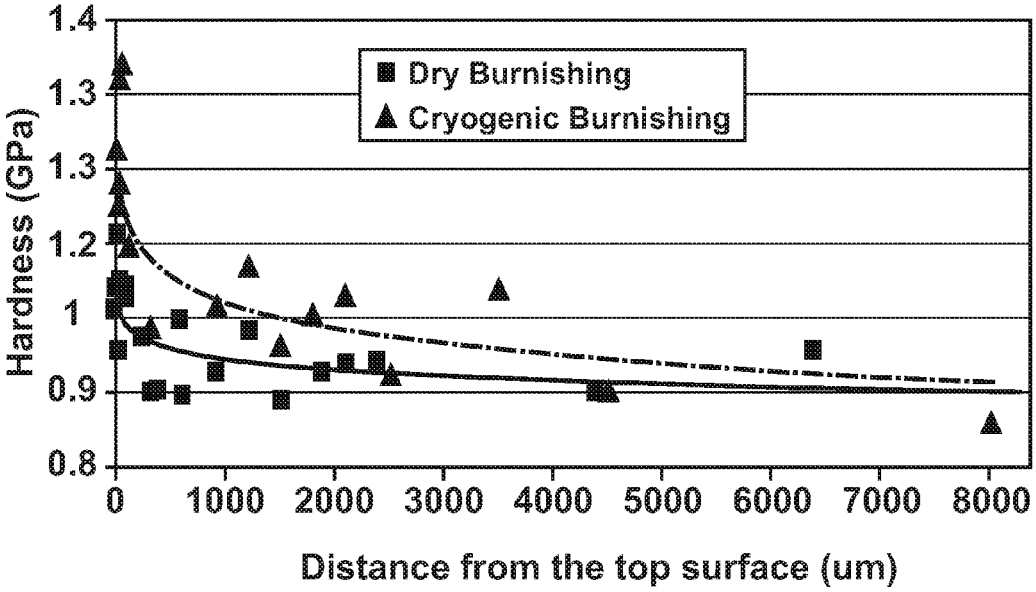
FIG. 6 is a graph showing the variation in hardness, measured in gigapascals (GPa), from the surface to the interior of a cryogenically-burnished AZ 31 B Mg sample (triangular data points) and of dry-burnished AZ 31B sample (square data points) burnished in an ambient environment (about 25° C.) without cooling.

FIG. 6 is a graph of hardness values (GPa) versus distance from the top (worked surface) for the cryogenic cooled disc sample of this experiment (triangle data points) and a like uncooled (dry burnished) disc sample (square data points). As shown in FIG. 6, the hardness values far away from the surface of the cryogenic cooled disc sample, which is not influenced by the processing, is about 0.9 GPa. After cryogenic burnshing, the hardness near the surface reaches 1.35 GPa. The relationship between hardness and grain size in AZ31 Mg alloys has been frequently reported in literature. The large increase in hardness agrees with the previous finding that significant grain refinement occurs near the surface after cryogenic burnishing. It is also seen on the curve for the dry burnished sample that the are generally lower.

Surface Roughness

Figure 7:
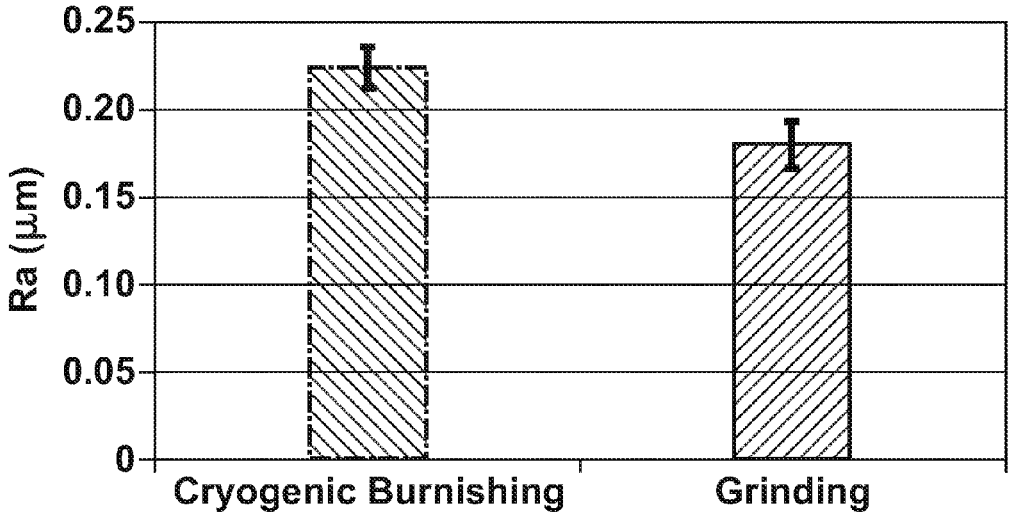
FIG. 7 shows two bar graphs comparing the arithmetic mean or average surface roughness (Ra), measured in micrometers (μm), of two AZ 31 Mg samples, one after cryogenic burnishing (triangular data points), the other after grinding (square data points).

FIG. 7 shows a comparison of the arithmetic mean or average surface roughness (Ra) between grinding and cryogenic burnishing. It shows that grinding generates a slightly smoother surface (lesser value of Ra), which, in general, ought to promote better corrosion resistance.

Electrochemical Measurements

Figure 8:
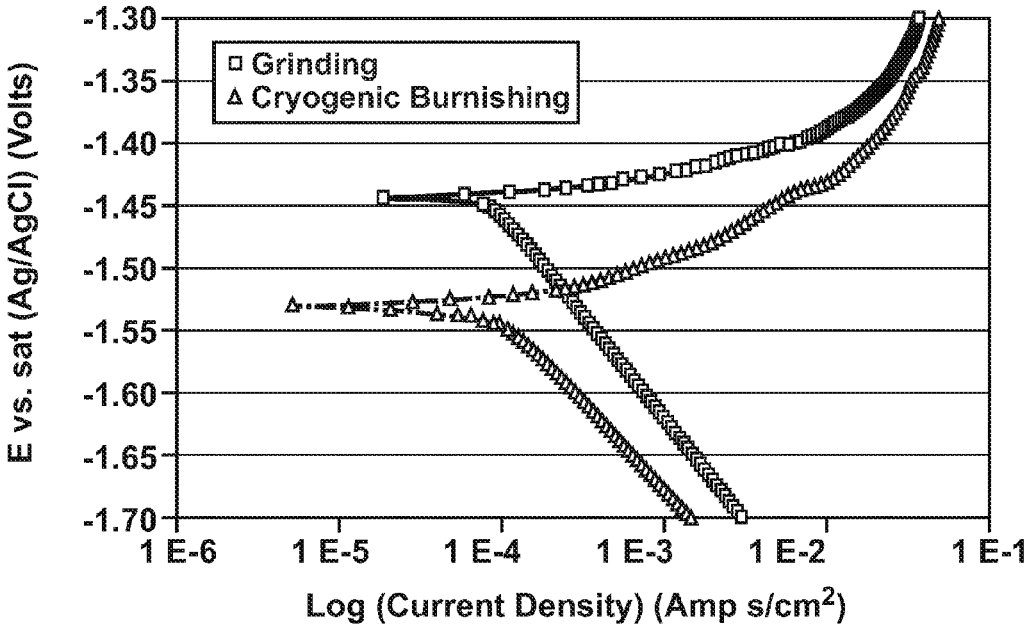
FIG. 8 shows polarization curves for AZ 31B Mg samples after cryogenic burnishing and grinding respectively.

The polarization curves of samples after grinding and after cryogenic burnishing are presented in FIG. 8. This data shows that the cathodic polarization current density after cryogenic burnishing is smaller than the one after grinding, which suggests that burnishing leads to improved corrosion resistance. However, there is a large shift in corrosion potential from −1.44 mV after grinding to −1.53 mV after cryogenic burnishing. While, in general, metals with lower potential are prone to more corrosion, both the literature and the current study show the opposite trend. Without wishing to be bound by any theory it is possible that the burnished surface of the present study promotes more rapid passivation of the surface layer to thereby retard the corrosion process.

Figure 9:
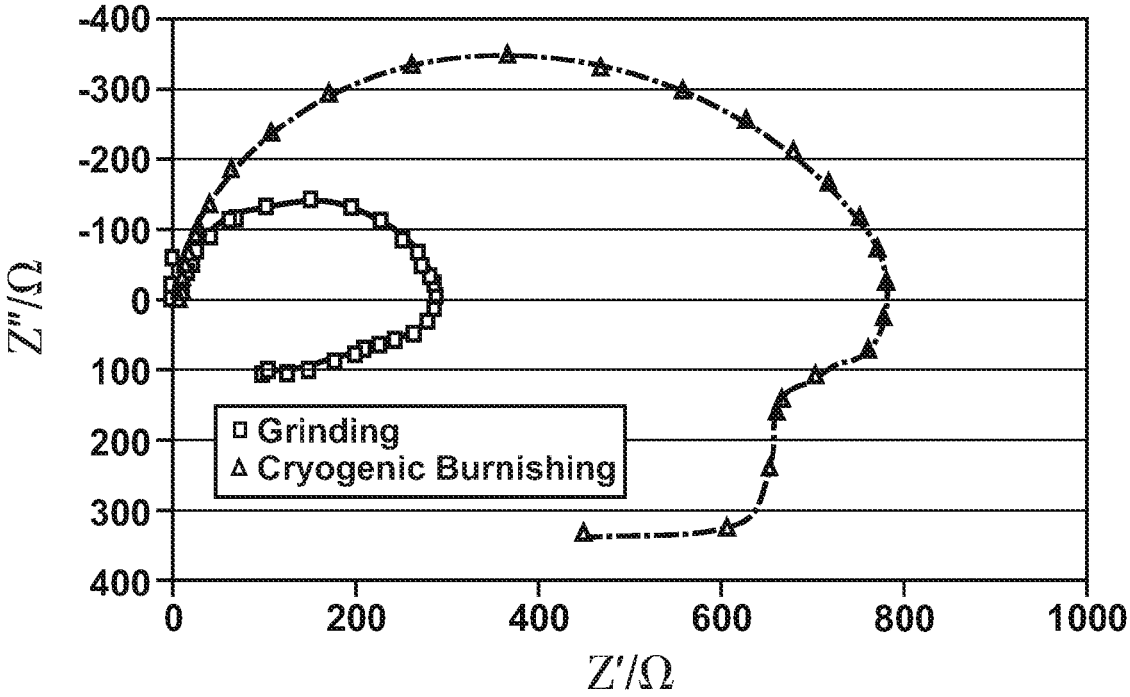
FIG. 9 shows AC impedance Nyquist spectra of AZ31B Mg samples immersed in 5 wt. % NaCl solution after grinding (square data points) and cryogenic burnishing (triangular data points) respectively.

FIG. 9 shows the Nyquist diagrams of AZ31B Mg samples after grinding and cryogenic burnishing in 5 wt. % NaCl. Both spectra have a clear capacitive arc at the high frequency region. The diameter of this capacitive loop at the high frequency region is associated with the charge-transfer resistance. The diameter for the sample after cryogenic burnishing is remarkably larger than the one after grinding, which suggests the sample after cryogenic burnishing has better corrosion resistance than the ground sample. This finding agrees with the trend of cathodic polarization current densities as shown in FIG. 8.

Hydrogen Evolution Measurement

Figure 10:
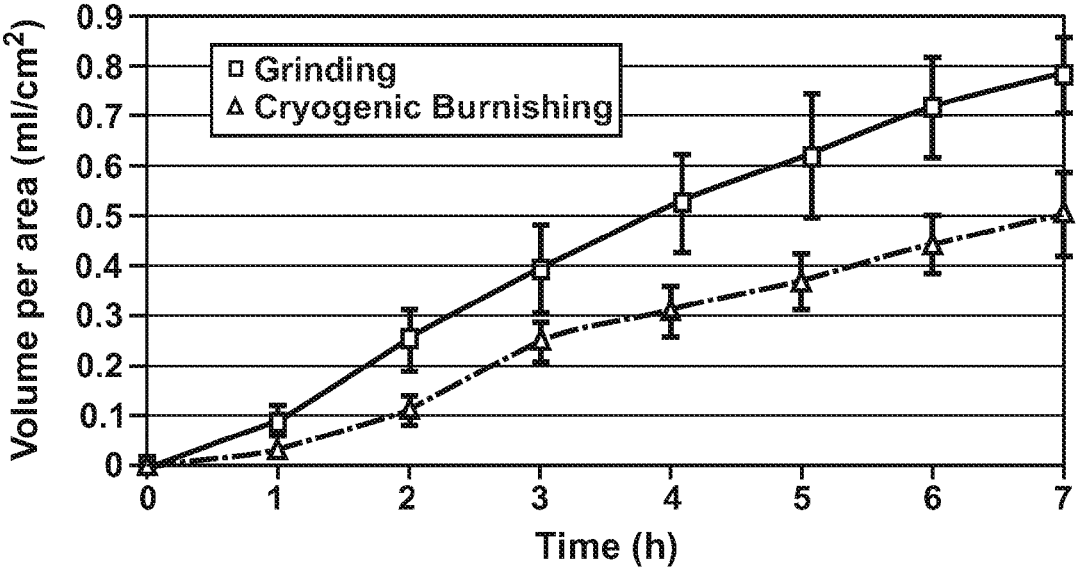
FIG. 10 shows cumulative hydrogen evolution, expressed as volume of hydrogen per unit area, with time of AZ 31B Mg samples immersed in 5 wt. % NaCl solution after grinding and cryogenic burnishing respectively.

The cumulative hydrogen evolution of the samples in 5 wt. % NaCl over time for samples after grinding and burnishing are presented in FIG. 10. It shows that more hydrogen is generated from the ground samples. Also, the scatter after grinding is larger than cryogenic burnishing. Since the cryogenic burnishing was carried out automatically on a CNC machine, it is expected that the process is more repeatable than grinding by hand. The finding from hydrogen evolution measurement further proves that the corrosion resistance of the AZ31B Mg alloy after cryogenic burnishing is improved compared with the corrosion resistance observed after grinding.

The present study shows that significant grain refinement as well as a large increase in hardness can be achieved in the surface layer of AZ31B Mg alloy after cryogenic burnishing. The microstructure of AZ31 up to 3.4 mm away from the surface can be remarkably changed by cryogenic burnishing. The mechanism for grain refinement is dynamic recrystallization.

Both the electrochemical method and hydrogen evolution methods show that the corrosion resistance of AZ31B Mg alloy is improved after burnishing. Such burnishing may be performed at ambient workpiece temperatures and with cooling of the worked surfaces of the workpiece to below ambient temperatures.

Practices of the subject invention provide an opportunity to improve material performance through fabricating a grain refined surface layer by burnishing and like modes of surface working and deformation. Not only corrosion resistance, but other properties, such as fatigue and wear resistance may also be significantly enhanced if proper processing conditions are used.

The original dimensions of the workpiece may be determined so as to allow for the deformation of the workpiece by the surface working operation.

The invention claimed is:

1. A method of producing a magnesium-based alloy surface layer on a surface of a magnesium alloy article to improve the resistance of the magnesium alloy surface to corrosion from contact with water, the method comprising:

traversing the surface of the article to be protected with a surface of a tool, by movement of the tool or of the article, and applying cooling liquid at cryogenic temperature to the article surface as the article surface is being traversed by the tool, the tool surface being pressed against the cryogenically-cooled surface of the article in sliding frictional contact to compress and deform the surface layer, without cutting material from the surface layer, to a predetermined depth to change the metallurgical grain structure of the surface layer, the tool repeatedly traversing the cryogenically-cooled surface while progressively advancing into continued engagement with the cryogenically-cooled surface, the changed surface layer having greater resistance to corrosion than an untreated region of the magnesium-based alloy article.

2. A method as recited in claim 1 in which the tool traverses the surface layer so as to alter the metallurgical structure of the surface layer of the article to a depth of about one to three millimeters.

3. A method as recited in claim 1 in which the tool traverses the surface layer so as to alter the metallurgical structure of the surface layer of the article to a depth of about one to three millimeters and to reduce the size of the metallurgical grains in the surface layer.

4. A method as recited in claim 1 in which the tool contacts the article surface at a location and the article surface is cryogenically cooled by application of liquid nitrogen to the article surface at the tool-contacting location as the article surface is being traversed by the tool so as to reduce the size of the metallurgical grains in the surface layer.

5. A method as recited in claim 1 in which the surface layer is compressed and deformed so that the sizes of the grains in the surface layer are reduced and made more uniform than the sizes of the original grains in the surface layer.

6. A method as recited in claim 1 in which the surface of the tool engaging the surface layer is flat and the tool is moved relative to the surface layer of a stationary article.

7. A method as recited in claim 1 in which the surface of the tool engaging the surface layer is flat and the surface layer of the article is moved relative to a stationary tool.

8. A method as recited in claim 1 in which the surface of the tool engaging the surface layer is a cylindrical surface and the cylindrical surface of the tool is moved relative to a stationary article.

9. A method as recited in claim 1 in which the surface of the tool engaging the surface layer is a cylindrical surface and the surface layer of the article is moved relative to a stationary tool.

10. A method as recited in claim 1 in which the average surface roughness property of the tool is lower than the initial average surface roughness of the surface of the article to be treated.

11. A method as recited in claim 5 in which the sizes of the grains in the surface layer of the article are reduced to an average grain size of less than about five micrometers.

12. A method as recited in claim 5 in which the sizes of the grains in the surface layer of the article are reduced to an average grain size of less than about two micrometers.

* * * * *